US005632123A

United States Patent [19]

Erwin

[11] Patent Number: 5,632,123

[45] Date of Patent: May 27, 1997

[54] COATED STEEL DECKING PLANK

[75] Inventor: Ronald D. Erwin, Fayetteville, Ga.

[73] Assignee: Erwin Industries, Inc., Peachtree City, Ga.

[21] Appl. No.: 616,527

[22] Filed: Mar. 19, 1996

[51] Int. Cl.[6] ..... E04F 15/06

[52] U.S. Cl. ..... 52/177; 52/730.1; 52/664; 52/650.3

[58] Field of Search ..... 52/650.3, 730.1, 52/664, 177

[56] References Cited

U.S. PATENT DOCUMENTS

| | | | |
|---|---|---|---|
| 2,007,354 | 7/1935 | Voss | 52/730.1 X |
| 3,764,245 | 10/1973 | Miyamoto | 425/131 |
| 3,881,984 | 5/1975 | Soda et al. | 156/500 |
| 4,045,603 | 8/1977 | Smith | 428/2 |
| 4,649,588 | 3/1987 | Taylor | 52/650.3 X |
| 4,709,519 | 12/1987 | Liefer et al. | 52/177 X |
| 4,885,882 | 12/1989 | Forshee | 52/177 |
| 4,889,669 | 12/1989 | Suzuki | 264/45.9 |
| 4,947,595 | 8/1990 | Douds et al. | 52/730.1 X |
| 5,087,488 | 2/1992 | Cakmakei | 428/31 |
| 5,412,915 | 5/1995 | Johnson | 52/177 |
| 5,475,951 | 12/1995 | Litzow | 52/177 |
| 5,483,773 | 1/1996 | Parisien | 52/650.3 X |

*Primary Examiner*—Robert Canfield
*Assistant Examiner*—W. Glenn Edwards
*Attorney, Agent, or Firm*—Arthur A. Gardner & Associates

[57] ABSTRACT

A decking plank for attachment to a support structure, such as wood deck joists, said decking plank comprising a unitary, elongated steel member including an upper panel, first and second generally upstanding walls for supporting the upper panel, and first and second mounting flanges for mounting the decking plank to the support structure, and wherein an outer surface of the upper panel is provided with a non-slip coating, and wherein the generally upstanding walls are spaced a selected distance from one another and the upper panel has a width exceeding the selected distance so as to create an overhang adjacent each generally upstanding wall for at least partly concealing the mounting flanges upon the installation of multiple ones of the decking plank in adjacent, side-by-side relationship. In another preferred form the invention comprises a method of manufacturing a steel decking plank for attachment to a support structure, such as to wood deck joists. The method comprises a first step of roll-forming corrosion-resistant steel to obtain a roll formed steel element with a desired shape including an upper panel, side walls, and mounting flanges. The roll formed steel element is then cleaned to prepare it for a subsequent coating operation. A coating is then applied to at least an upper surface of the roll formed steel element and the coating is then cured. Before the coating is fully cured, a grit is applied to the upper panel.

9 Claims, 2 Drawing Sheets

COATED STEEL DECKING PLANK

TECHNICAL FIELD

The present invention is directed to decking products, in particular a steel decking plank having a non-slip surface coating and a method for manufacturing such a decking plank with such a surface coating.

BACKGROUND OF THE INVENTION

Outdoor decks have become increasingly popular in residential home construction. Homes and apartments, as well as a variety of other buildings, often incorporate exterior decks into their design. Additionally, decks are commonly added onto existing structures. These decks provide convenient spaces for a variety of outdoor activities, including cook-outs, dining, and sunbathing, as well as other leisure activities.

Typical deck construction includes: (1) a number of vertical posts which support the remaining structure above the ground; (2) horizontal beams supported above the ground by the vertical posts; (3) a number of horizontal joists, parallel to and uniformly spaced apart from one another and anchored to the beams; and (4) a floor surface of decking planks arranged horizontally and above and perpendicular to the joists.

Wood products have traditionally been the primary source of materials for use in decking construction. However, wood products are becoming increasingly scarce due to the harvesting of trees at ever faster rates and the rather limited rate at which timber resources have been replenished. Also, environmental concerns and environmental regulations directed to the conservation or preservation of forests tend to restrict the availability of wood products. With diminishing availability of timber resources, wood products are becoming increasingly expensive. There is, therefore, a substantial need for long-lasting substitute construction materials that can lessen the need to harvest timber resources.

Moreover, wood decks are usually made from pressure-treated lumber. As part of the treatment of such lumber during the manufacturing process, the lumber absorbs chromated copper arsenic. Before the treated lumber is delivered to local lumber yards and home centers, it is cured outside where some of the chromated copper arsenic leaches out and winds up in the ground (and perhaps the water table).

It has been found that one potential approach to addressing the above need is to provide substitute replacement decking products made of plastic, rather than wood. Because the deck surface must support substantial weight and foot traffic, however, the replacement product needs to be stable and rigid. The material should also be capable of economical manufacture, and be relatively inexpensive. It also needs to be easily fabricated and used in the field.

A variety of plastic building products are known. For example, U.S. Pat. No. 4,045,603 describes a three layer synthetic construction material made from recycled waste thermoplastic synthetic resin material and cellulose fiber aggregate. This material includes face surfaces consisting essentially of re-hardened fused and rolled thermoplastic synthetic resin material bits, and an intervening core material consisting essentially of a compressed non-homogenous mixture of cellulose aggregate material bits and re-hardened fused thermoplastic synthetic resin material bits.

U.S. Pat. No. 3,764,245 describes an apparatus for producing a light structural board of thermoplastic resin.

U.S. Pat. No. 5,253,458 describes a simulated log made from a cast polyvinylchloride (PVC) pipe, selectively filled with a hard cast foam or a bead type foam. This patent further describes that the cast PVC pipe is first manufactured and then subsequently filled with the foam filler.

A common disadvantage suffered by previously known synthetic building materials, however, is that plastic surfaces provided thereby tend to be more slippery than traditional wood products. This problem is exacerbated when the building product is used in a decking and the decking surface becomes wet, as from rain or being washed. Additionally, previously known synthetic materials are less wear-resistant than traditional wood decking, and therefore, are more prone to scuffing and to other damage from foot traffic.

Accordingly, it can be seen there is yet a need in the art for a replacement decking having a surface coating which provides a non-slip walking surface, which resists wear from foot traffic and which can be produced and applied economically. It is to the provision of such a decking that the present invention is primarily directed.

SUMMARY OF THE INVENTION

Briefly described, in a preferred form the present invention comprises a decking plank for attachment to a support structure, such as wood joists, and the decking plank comprises a unitary, elongated steel member including an upper panel, first and second generally upstanding walls for supporting the upper panel, and first and second mounting flanges for mounting the decking plank to the support structure. An outer surface of the upper panel is provided with a non-slip coating. Also, the generally upstanding walls are spaced a selected distance from one another. The upper panel has a width which exceeds the selected distance so as to create an overhang adjacent each generally upstanding wall for at least partly concealing the mounting flanges upon the installation of multiple ones of the decking plank in adjacent, side-by-side relationship.

Preferably, the upper panel has a slight crown to assist water run-off and the mounting flanges include mounting/drain holes which are spaced eight inches apart, whereby upon mounting the steel decking planks to the joists on sixteen inch centers, the spacing of the mounting/drain holes allows every other hole to operate as a drain hole or weep hole. Also, preferably the mounting flanges are sized and configured such that upon multiple ones of the decking planks being installed in adjacent, side-by-side relationship, a small gap is provided between the upper panels.

In another preferred form the invention comprises a method of manufacturing a steel decking plank for attachment to a support structure, such as to wood deck joists. The method comprises a first step of roll-forming corrosion-resistant steel to obtain a roll formed steel element with a desired shape including an upper panel, side walls, and mounting flanges. The roll formed steel element is then cleaned to prepare it for a subsequent coating operation. A coating is then applied to at least an upper surface of the roll formed steel element and the coating is then cured. Before the coating is fully cured, a grit is applied to the upper panel.

Preferably, the coating is a UV-stabilized coating and the grit is a silica sand which is applied by gravity using a hopper, a screen and by shaking the hopper and screen.

The decking planks made of this construction and using the manufacturing process according to the invention are durable, strong, stable, and wear-resistant. These steel decking planks also resist warping, cracking, and checking, which problems are common in wood products. The steel decking planks according to the invention provide a good non-slip surface and provide good drainage (particularly through the combination of the crowned upper panel and the drain holes). Also, these steel decking planks are corrosion-resistant and long-lasting. Moreover, the steel decking planks according to the invention are easily and economically manufactured and installed.

Accordingly, it is an object of the present invention to provide a decking plank which is durable, strong, stable, and wear-resistant.

It is another object of the present invention to provide a decking plank which resists warping, cracking, and checking.

It is another object of the present invention to provide a decking plank which has a non-slip upper surface and which drains water effectively.

It is another object of the present invention to provide a steel decking plank which is corrosion-resistant.

It is another object of the present invention to provide a decking plank and process for manufacturing the same which is economical and practical.

It is another object of the present invention to provide a decking plank which is quickly, easily, and economically installed.

These and other objects, advantages, and features of the invention will become more apparent upon reading the following specification in conjunction with the accompanying drawing figures.

BRIEF DESCRIPTION OF THE DRAWING FIGURES

DETAILED DESCRIPTION OF THE PREFERRED EMBODIMENT

Figure 1:
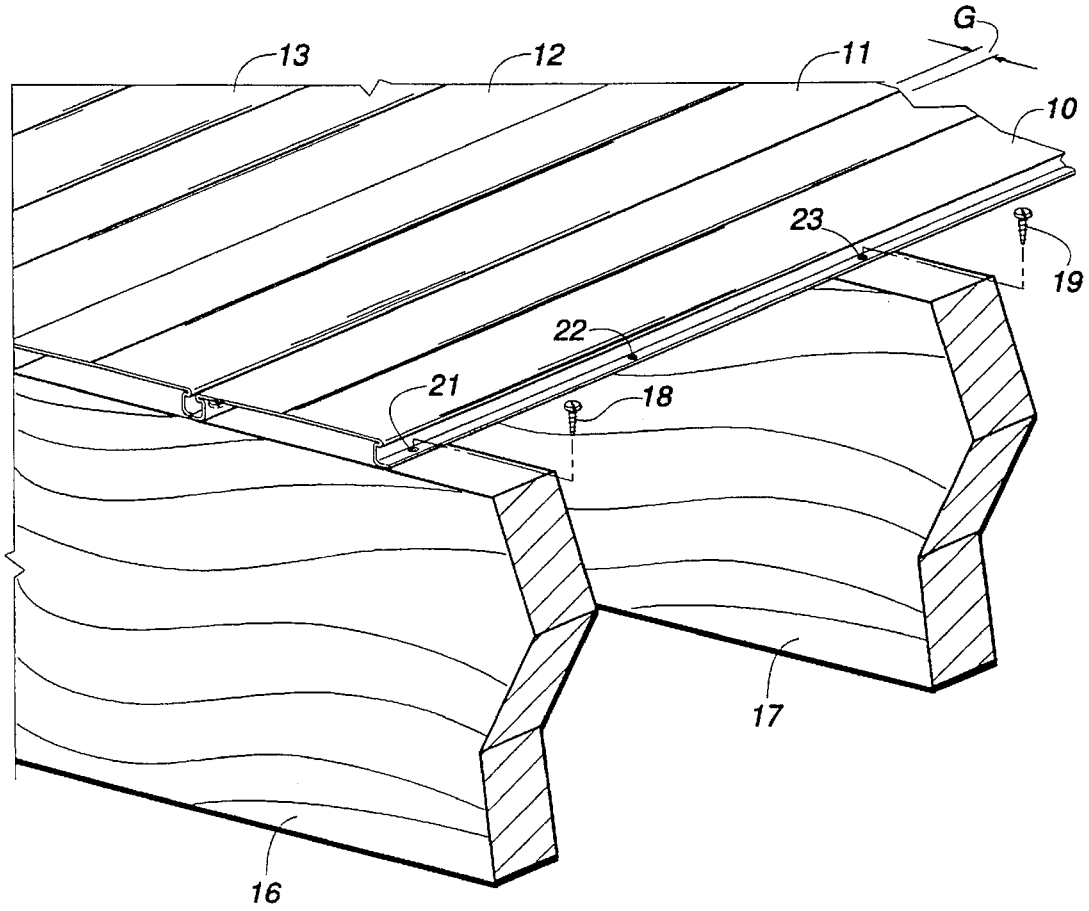
FIG. 1 is a schematic, perspective illustration of a number of coated steel decking planks according to a first preferred form of the invention, shown mounted to wood deck joists.

Referring now in detail to the drawing figures, wherein like reference numerals represent like parts throughout the several views, FIG. 1 shows several coated steel decking planks 10, 11, 12, and 13 according to a preferred form of the invention. The coated steel decking planks 10–13 are shown attached to typical wood support joists, such as joists 16 and 17. The coated steel decking planks 10–13 are attached to the joists with fasteners, such as fasteners 18 and 19. These fasteners are fitted through fastener/drain holes arranged along the edge of the coated steel decking planks, such as fasteners/drain holes 21, 22, and 23. The fastener holes are spaced eight (8) inches apart from one another and continue along the entire length of both sides of each steel coated decking plank. With deck joists typically being spaced apart from one another on 16-inch centers, this allows every other drain hole, such as drain hole 22 in FIG. 1, to pass water therethrough to drain excess water from the deck. With adjacent ones of the coated steel decking planks arranged in an adjacent, side-by-side relationship as shown in FIG. 1, a small gap G is provided between adjacent ones of the decking planks. This gap G allow the fasteners to be installed and removed. Also, this gap allows water to drain from on top of the planks to between the planks and ultimately out of the drain holes not being used to secure the planks to the joists. This gap also helps to simulate the appearance consumers have come to expect of wood decking. Preferably, this gap is between about 3/16 and 3/8 of an inch. Most preferably, this gap is about 5/16 of an inch. The dimension of this gap is automatically set by the configuration and dimensions of the individual planks.

Figure 2:
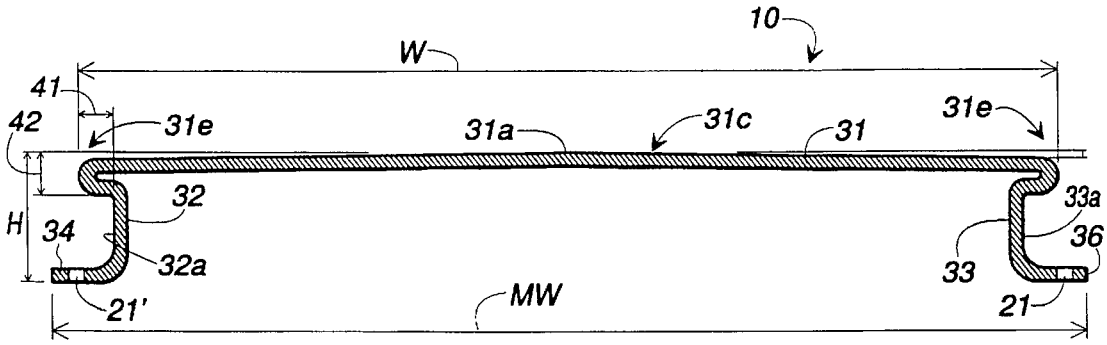
FIG. 2 is a cross-sectional view of a coated steel decking plank of FIG. 1.

Referring now to FIG. 2, the structural details of an individual coated steel decking plank according to a preferred form of the invention are considered. The coated steel decking plank 10 includes an upper panel 31, vertically extending side walls 32 and 33, and mounting flanges 34 and 36. The decking plank 10 is made from a unitary piece of steel. Preferably, the decking plank 10 is made from corrosion-resistant steel, such as galvanized steel. Also preferably, the decking plank 10 obtains its shape shown in FIG. 2 by a roll forming process, which is quite economical. Also preferably, the upper surface 31*a* of the panel 31, the outer surfaces 32*a* and 33*a*, and the upper surfaces of the mounting flanges 34 and 36 are provided with a UV-stabilized coating to resist corrosion and to give the decking planks a pleasing appearance. If the decking plank is to be used near water, such as for a dock along a river, lake, or ocean, the underside and interior surfaces are coated as well. Preferably the UV-stabilized coating is a polyester coating, a vinylester coating, a polyester and acrylic mix, a polyurethane, or an epoxy. Preferably, the coating is approximately 0.015 inches thick.

Preferably, the decking plank 10 is made from steel having a thickness from between about 0.065 and 0.090 inches. Most preferably, the decking plank 10 is made from steel with a thickness of about 0.070 inches.

As shown in FIG. 1, the upper panel 31 is slightly crowned. That is, there is a change in height from a center portion 31*c* to the edges 31*e* of the upper panel 31. Preferably, the amount of this crown is approximately 1/32 of an inch.

As shown in FIG. 2, the upper panel 31 has a width W which is preferably 5 and 11/16 inches. Also, the decking plank 10 has a maximum width MW of approximately 6 inches.

Preferably, the decking plank 10 has a height of 3/4 of an inch when measured from the crown 31*c* to the base of the mounting flanges 34 and 36.

Adjacent the ends 31*e* of the upper panel 31, the ends 31*e* extend outwardly laterally beyond the upright walls 32 and 33 to create an overhang or cave. The extent of this overhang or cave is indicated by dimension 41. Preferably, this overhang dimension 41 is about 3/16 to 1/4 inch. The ends 31*e* of the upper panel are U-shaped and have a height of approximately 1/4 inch, indicated by dimension 42.

As further shown in FIG. 2, the mounting flanges include mounting/drain holes, such as holes 21 and 21'. Also, the ends of the mounting flanges 34 and 36 extend outwardly laterally beyond the outermost edges 31*e* of the upper panel 31. Preferably, each of the mounting flanges extends beyond the edge of the upper panel by approximately 5/32 of an inch. During installation of the decking planks, the mounting flange of one decking plank is positioned adjacent a mounting flange of an adjacent decking plank. Fasteners are then extended through the mounting holes and screwed into the deck joists.

Figure 3:
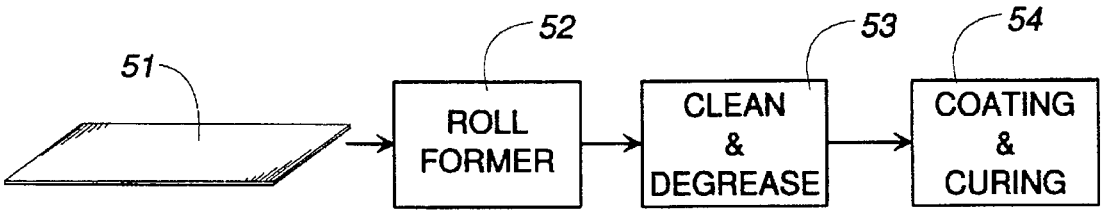
FIG. 3 is a schematic illustration of a manufacturing process for making the coated steel decking plank of FIG. 1.

To manufacture the decking plank 10, a process according to that shown in FIG. 3 is used. As shown in FIG. 3, a galvanized steel blank 51 is passed through a roll former 52 to obtain a roll formed steel element having the shape of the decking plank shown in FIG. 2. After the roll forming process, a certain amount of grease, dirt, or oil may be present on the surfaces of the roll formed steel element. In order to prepare the roll formed steel element for subsequent coating, the roll formed steel element is then cleaned with conventional cleaning and de-greasing equipment 53. After cleaning and de-greasing, the cleaned, roll formed steel element is passed to a coating and curing operation 54.

Figure 4:
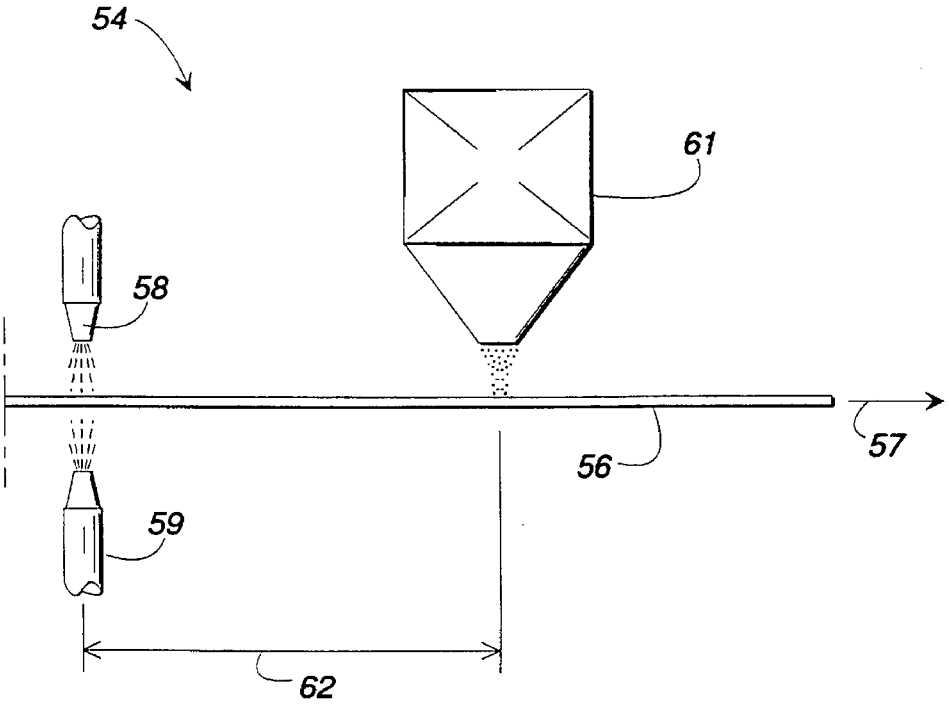
FIG. 4 is a schematic illustration of a portion of the process of FIG. 3.

The coating and curing operation 54 is shown in better detail in FIG. 4. As shown in FIG. 4, the cleaned and de-greased roll formed steel element 56 is moved in a forward direction indicated by direction arrow 57. The cleaned and de-greased roll formed steel element 56 passes coating spray nozzles, such as spray nozzles 58 and 59. The spray nozzles spray the upper and outside surfaces, and where appropriate the under and interior surfaces, of the cleaned, roll formed steel element. An apparatus 61 is positioned a distance 62 downstream of the spray nozzles. The apparatus 61 applies a grit to the coating while the coating is still not fully cured. In this regard, the distance 62 is chosen in relation to the speed at which the roll formed steel element 56 is traveling and also in relation to the amount of time it takes for the coating to cure. In other words, the apparatus 61 is positioned at a place so that the grit which is applied thereby is applied to the coating while the coating is still not fully cured. This allows the grit to be adhered to or embedded in the coating and to become a permanent part of the coating. Preferably, the grit is a white silica sand, although other grits can be employed. Also, preferably, the grit is applied using a hopper (such as depicted in FIG. 4) with a lower screen and by shaking the hopper and screen to discharge the grit at a reasonably uniform rate. Other means of applying the grit could be used, such as by spraying the grit on. Also, the grit can be mixed with the coating and the mixture of coating and grit can be sprayed on.

While the invention has been disclosed in preferred forms, it will be apparent to those skilled in the art that many additions, deletions, and modifications may be made therein without departing from the spirit and scope of the invention as set forth in the following claims:

What is claimed is:

1. A decking plank for attachment to a support structure, such as wood deck joists, said decking plank comprising:

a unitary, elongated steel member including an upper panel, first and second generally upstanding walls for supporting said upper panel, and first and second mounting flanges for mounting said decking plank to the support structure, said mounting flanges extending laterally outwardly from said walls, and wherein an outer surface of said upper panel is provided with a non-slip coating, and wherein said generally upstanding walls are spaced a selected distance from one another and said upper panel has a width exceeding said selected distance so as to create an overhang adjacent each generally upstanding wall for at least partly concealing said mounting flanges upon the installation of multiple ones of said decking plank in adjacent, side-by-side relationship.

2. A decking plank as claimed in claim 1 wherein said upper panel is crowned to assist water run-off.

3. A decking plank as claimed in claim 2 wherein said crown is approximately 1/32 of an inch in height.

4. A decking plank as claimed in claim 1 wherein said overhangs have an edge with a radius.

5. A decking plank as claimed in claim 4 wherein said radius is between about 3/16 and 1/4 inch.

6. A decking plank as claimed in claim 1 wherein said mounting flanges extend outwardly laterally from said walls more than said overhangs extended beyond said walls.

7. A decking plank as claimed in claim 1 wherein said mounting flanges include mounting/drain holes spaced eight inches apart, whereby upon securing the steel decking plank to wood joists on sixteen inch centers, the spacing of the mounting/drain holes allows every other hole to operate as a drain.

8. A decking plank as claimed in claim 1 wherein said mounting flanges are sized and configured such that upon multiple ones of said decking plank being installed in adjacent, side-by-side relationship, a gap of between about 3/16 and 3/8 inch is provided between said upper panels.

9. A decking plank as claimed in claim 8 wherein said gap is about 5/16 inch.

* * * * *